US005893569A

United States Patent [19]

Robins

[11] Patent Number: 5,893,569

[45] Date of Patent: Apr. 13, 1999

[54] INLINE HOCKEY SKATE

[75] Inventor: Duncan G. Robins, Woodland Hills, Calif.

[73] Assignee: Jas. D. Easton, Inc., Van Nuys, Calif.

[21] Appl. No.: 08/745,268

[22] Filed: Nov. 8, 1996

[51] Int. Cl.[6] ..... A63C 17/14

[52] U.S. Cl. ..... 280/11.2; 152/456; 188/5; 280/11.22; 301/5.3

[58] Field of Search ..... 188/4 R, 4 B, 188/5; 301/5.1, 5.3, 5.7; 280/11.2, 11.22, 11.23, 11.24, 11.27, 842, 843, 11.26; 152/455, 456

[56] References Cited

U.S. PATENT DOCUMENTS

| | | | |
|---|---|---|---|
| 1,868,548 | 7/1932 | Turner | 280/11.22 |
| 2,073,708 | 3/1937 | Parrish | 280/11.23 X |
| 2,220,557 | 11/1940 | User | 280/11.22 |
| 3,693,988 | 9/1972 | Steinhiser | 280/11.26 X |
| 3,880,441 | 4/1975 | Silver | 280/11.22 |
| 4,768,793 | 9/1988 | Spencer | 280/11.23 X |
| 5,096,225 | 3/1992 | Osawa | 280/842 |
| 5,129,709 | 7/1992 | Klamer | 301/5.3 |
| 5,207,438 | 5/1993 | Landers | 280/11.2 |
| 5,251,920 | 10/1993 | McHale | 280/11.19 |
| 5,401,037 | 3/1995 | O'Donnell et al. | 280/11.2 |
| 5,411,277 | 5/1995 | Pratt | 280/11.27 X |
| 5,505,470 | 4/1996 | Hoshizaki | 280/11.22 |
| 5,590,890 | 1/1997 | Rosso et al. | 280/11.22 |
| 5,641,365 | 6/1997 | Peterson et al. | 280/11.22 X |

*Primary Examiner*—J J Swann
*Assistant Examiner*—Michael Mar
*Attorney, Agent, or Firm*—Flehr Hohbach Test Albritton & Herbert LLP

[57] ABSTRACT

An inline roller skate includes a large number of small, light weight wheels arranged along a downwardly convex arcuate line to form a rocker. Braking elements are disposed along a common axis with at least some of the wheels, the braking elements may take the form of various surfaces of revolution, such as conical, cylindrical, ellipsoidal or semi-spherical. The braking elements are arranged to contact the skating surface when the skater shifts his foot to a direction perpendicular to his direction of movement and leans back on his skate so as to perform an "ice skating" type braking action.

27 Claims, 5 Drawing Sheets

INLINE HOCKEY SKATE

BACKGROUND OF THE INVENTION

This invention relates to tandem or inline roller skates which are particularly suitable for playing hockey. Hockey has long been a popular game on ice and, of course, hockey players are most familiar with ice skates and the particular type of ice skate used in playing hockey. Such hockey ice skates provide a great deal of maneuverability to permit a skater to change directions and stop frequently. This is in contrast with the normal recreational ice skating as well as the normal recreational roller skating. Inline roller skates have been developed primarily for recreational use although inline roller skates have been used for playing hockey for over 20 years; see, for instance, U.S. Pat. No. 3,880,441 for a Tandem Roller Hockey Skate.

During the long history of inline hockey skates many changes have been made but in all instances the inline hockey skate is substantially different from the ice hockey skate due principally to the natural differences between the thin blade of the ice skate as opposed to the rollers required for the inline skate. One substantial difference is the weight of the skate. The inline skate, even today after more than 20 years of improvement, is approximately 65% heavier than an ice skate of the same size and general boot construction. Moreover, the inline hockey skates developed to date are constructed such that the soles of the skater's feet are positioned much higher from the skating surface than is the case with the ice skates. Ice skates normally position the sole of the boot only about 6 cm above the ice whereas the inline hockey skate places the sole approximately 8 cm above the skating surface. This is due to the fact that the wheels for inline hockey skates normally have a 72 to 80 mm tread diameter.

Ice hockey skates also differ from most roller skates in that the blade is normally ground to a curvature having a radius of about 3 meters so as to provide what is generally known as a "rocker." Such a rocker curved shape permits the skater to tip his foot forward or backward to a moderate extent and still maintain the same contact with the ice. This has been accomplished only somewhat with inline hockey skates to date wherein three to five wheels are employed and positioned at two different levels from the sole of the boot. Such an arrangement permits the skater to set the sole of his foot at any of three different angles with the skating surface. One such configuration is shown in U.S. Pat. No. 5,505,470. In other arrangements, the various inline wheels are placed on pivoting carriages which likewise permits three possible angles with the skating surface. Such a construction is offered by BMR Manufacturing which calls the arrangement a "floating rocker system."

Another important difference between ice hockey skates and inline hockey skates is the manner and ability of stopping. In ice skating the skater ordinarily comes to a quick stop by shifting the blade of his skates to a direction perpendicular to the direction of movement and lean back thereby providing sufficiently high friction scraping to come to a quick stop. With inline skates the usual manner of stopping is to use a brake snubber on the heel or toe of the boot to provide braking friction while the skate is still directed in the line of movement. Even so, many users of inline hockey skates attempt to stop in the ice skating manner using not only the normal roller blade wheels but also more spherically shaped wheels such as skates offered by RollerBall International, Inc. of Los Angeles, Calif. Other forms of braking have also been considered and tried such as hand operated application of friction on the wheels themselves.

BRIEF SUMMARY OF THE INVENTION

The inline hockey skates of the invention conform far more closely to the parameters of the ice hockey skate than have inline skates of the prior art. This is accomplished by a combination of features providing an inline hockey skate having a weight much closer to that of the an ice hockey skate; having substantially the same rocker action as the ice hockey skate; having a height from the skating surface approximately the same as the ice hockey skate; and providing the ability to stop in the same general fashion as the ice hockey skate.

These results are obtained by the use of much smaller and lighter wheels than has ordinarily been available for the inline hockey skates and by providing a greater number of wheels than is ordinarily utilized. "Virtual edges"—emulative of the edges on ice skate blades—are provided as braking surfaces close to the inside edges of the wheels themselves. The braking surfaces can take many different forms including cylindrical, conical, semispherical and ellipsoidal shapes. The numerous wheels are arranged on a radius so as to provide the rocker action of the ice skate. In an alternative embodiment of the invention the rocker is provided with the wheel axles positioned not on a radius but rather on some other convexly curved line so as to provide multiple lines of contact formed by different sets of adjacent wheels.

BRIEF DESCRIPTION OF THE DRAWING

Additional objects and features of the invention will be more readily apparent from the following detailed description and appended claims when taken in conjunction with the drawings, in which:

DESCRIPTION OF THE PREFERRED EMBODIMENT

Figure 1:
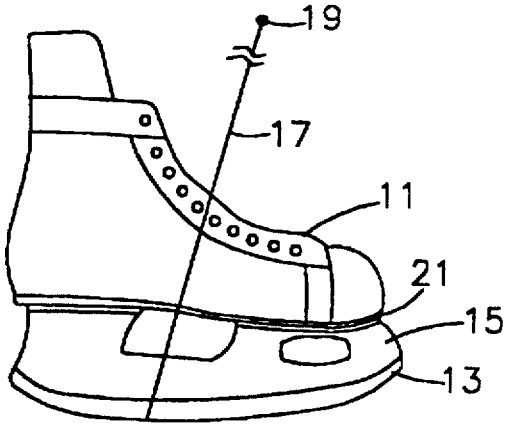
PRIOR ART FIG. 1
FIG. 1 is a side elevational view of an ice hockey skate of the prior art showing, in emphasized fashion, a rocker radius of about 3 meters.

Referring to FIG. 1, there is shown a standard hockey ice skate having a usual boot 11 and a blade 13 secured to the boot by means of an elongated frame 15. The blade is shown, in exaggerated form, to have a radius designated by the arrow 17 to a center 19. The radius is usually on the order of about 3 meters. Thus the skater can rock his foot forwardly or rearwardly along the radius curve of the blade and can easily shift his weight to the portion of blade he deems proper at the time.

The average distance from the bottom of the blade 13 to the bottom of the sole 21 on the boot 11 is an average of about 6 cm, thereby providing the skater a relatively stable footing. Moreover the blade 13 and the frame 15 are relatively small and are formed of light weight material, thereby contributing very little to the overall weight of the skate itself.

Figure 2:
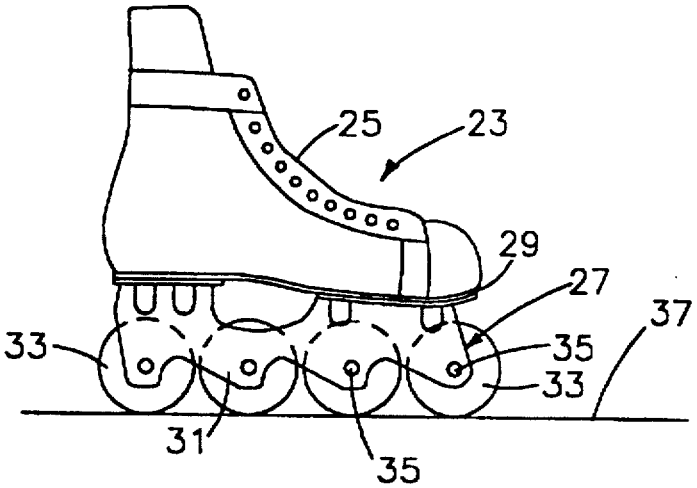
PRIOR ART FIG. 2
FIG. 2 is a side elevational view of an inline skate of the prior art.

Referring now to FIG. 2, an inline roller skate 23 of the type presently used for playing hockey is shown. The skate 23 includes the usual boot 25 and a frame 27 including an inverted "U" shaped structure having a top portion attached to the sole 29 and a pair of downwardly extending side faces or brackets 31. A plurality of wheels 33 are arranged in tandem and secured between the side faces 31 by a series of axles 35.

Figure 3:
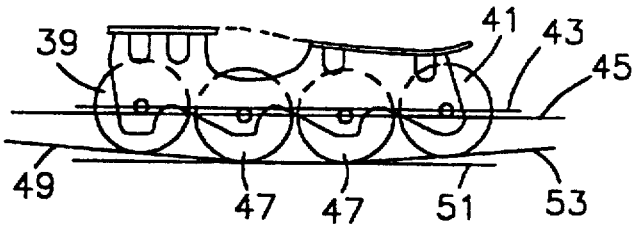
PRIOR ART FIG. 3
FIG. 3 is a partial side elevational view of an inline skate of the prior art having one type of simulation of a "rocker" effect.

As seen in FIG. 2 all of the wheels 33 lie in contact with the skating surface 37. In some instances a type of rocker is provided by having the rear and forward wheels being somewhat smaller than or arranged somewhat higher than the two center wheels. An example of such a rocker is shown in FIG. 3 where the rear wheel 39 and forward wheel 41 lie on a line 43 slightly above the line 45 connecting the center wheels 47. The skate may then contact the surface on any two adjacent wheels. Such skates have four wheels as shown and consequently there are three possible lines 49, 51 and 53 of contact with the surface.

Figure 4:
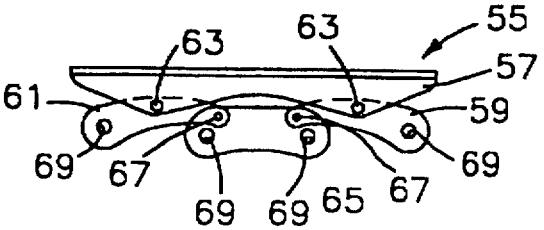
PRIOR ART FIG. 4
FIG. 4 is a partial side elevational view of another inline skate of the prior art having a pivoting type of a "rocker" simulation.

Another simulation of rocker action has employed a set of pivoting frames as shown in FIG. 4. In this example, the frame 55 includes a bracket 57 secured to the sole of the boot. A pair of frames 59 and 61 are mounted to the bracket 57 by means of pivots 63 and a third frame 65 is mounted on the two frames 59 and 61 by means of pivots 67. Wheels are mounted on the frame 55 by means of axles mounted in the holes 69. With this construction, all four wheels may contact the skating surface simultaneously if the bracket 57 is kept parallel to the surface. On the other hand, if the heel is lifted, the pivoting action of the frames 59, 61 and 65 place the forward three wheels only in contact with the surface. Conversely, if the toe is lifted, a similar action places the rear three wheels in contact with the surface.

The inline skates of FIGS. 2, 3 and 4, because of the usual size of the wheels, have an average distance of about 8 cm from the bottom of the wheels 33 to the bottom of the sole 29 thereby raising the sole of the skater's foot about an inch higher than would normally be the case with the ice skate of FIG. 1.

Figure 5:
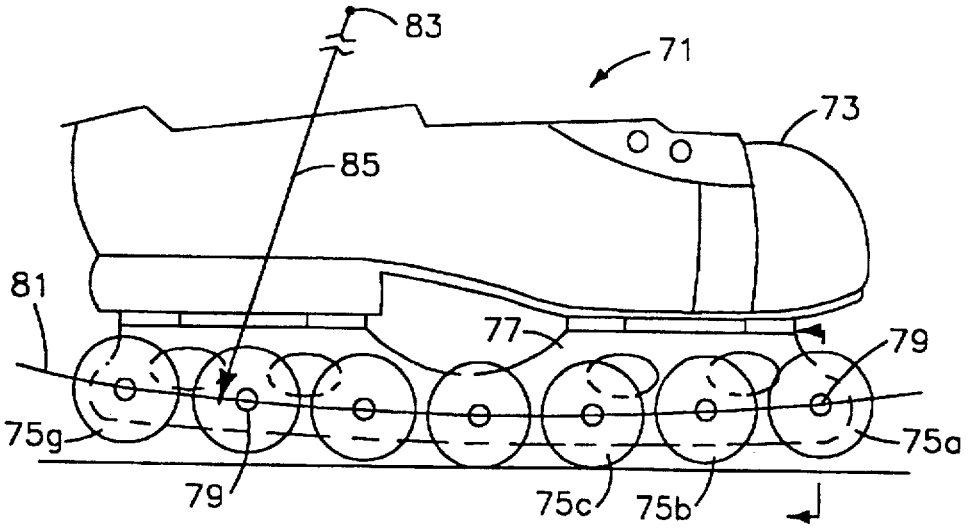
FIG. 5 is a side elevational view of an inline hockey skate in accordance with the invention.

Referring now to FIG. 5, there is shown an inline skate 71 in accordance with the invention having the usual boot 73 with a series of wheels 75 rotatably secured to a frame 77 by means of axles 79. The axles 79 are secured onto the frame 77 in an arcuate path 81 about a center point 83 with a radius line 85 of about from 2 to 4 meters, but preferably of about 3 meters. In order to provide as many wheels as possible for rocker action and to lower the boot as closely as possible to the skating surface, the tread diameter of the wheels is less than 50 mm. Moreover, the tread element, that is the portion corresponding to the usual wheel, is considerably narrower in the axial direction than is the usual inline wheel and is preferably less than 15 mm wide.

Figure 6:
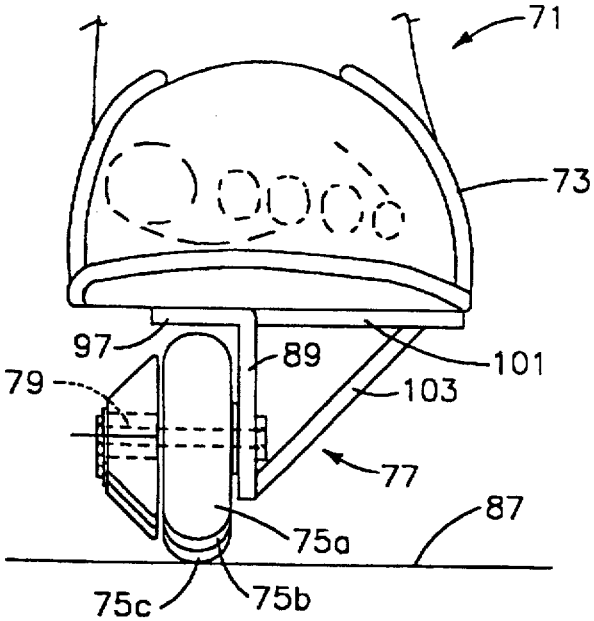
FIG. 6 is a front elevational view of the skate shown in FIG. 5.

As seen in FIG. 6, which is a front elevation of the skate shown in FIG. 5, the front wheel 75*a* is shown raised from the skating surface 87 whereas the second wheel 75*b* is somewhat closer to the surface 87 and the third wheel 75*c* is actually in contact with the ground surface 87 all due to the arcuate disposition of the wheels on the frame 77.

Figure 7:
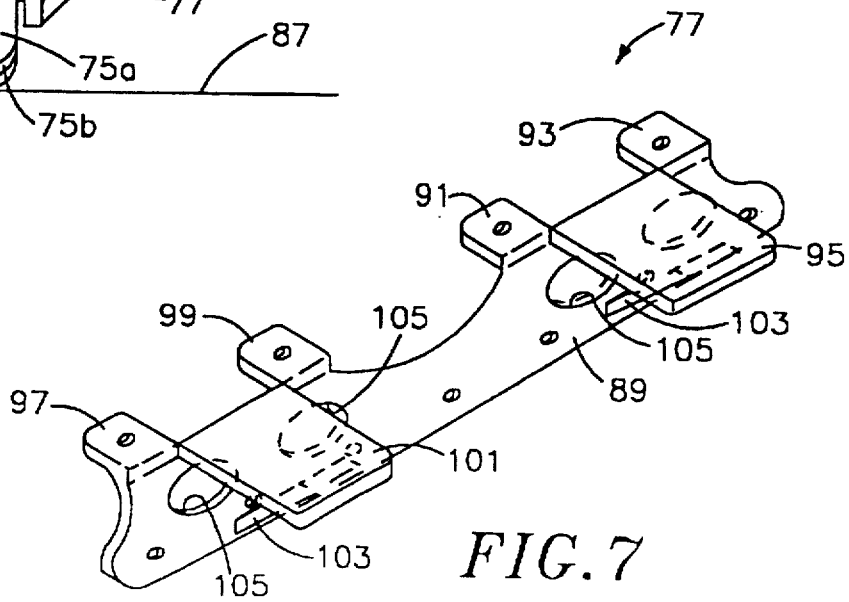
FIG. 7 is a perspective view of a frame for carrying the wheels and "virtual edge" braking elements of the skate shown in FIGS. 5 and 6.

As seen in FIG. 7, the frame 77 comprises a vertical bracket 89, a pair of rear horizontal flanges 91 and 93 extending to the inside of the boot and a larger rear horizontal flange 95 extending to the outside of the boot. A similar set of inside flanges 97 and 99 and an outside flange 101 are located at the forward end of the frame 77. In addition one or more tension rods 103 may be added to provide extra strength. Depending upon the strength of the material used, one or more openings 105 in the bracket may be provided to further lessen the weight.

Figure 8:
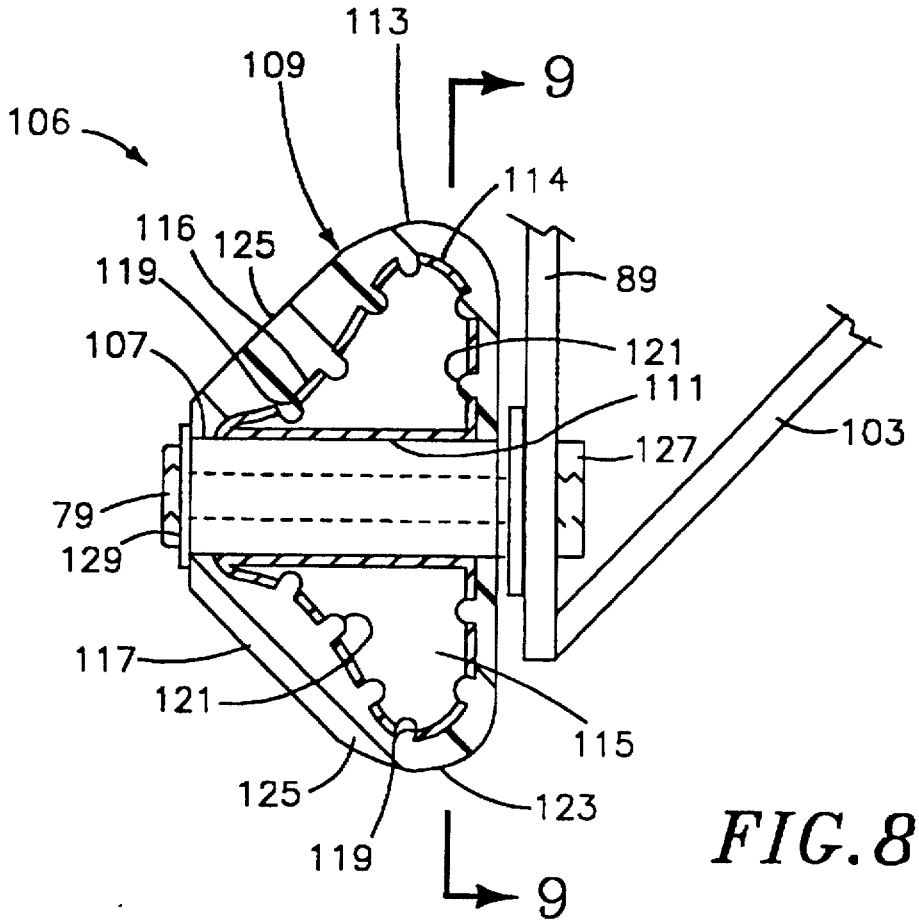
FIG. 8 is an enlarged cross sectional view of a preferred form of wheel used with the invention.
Figure 9:
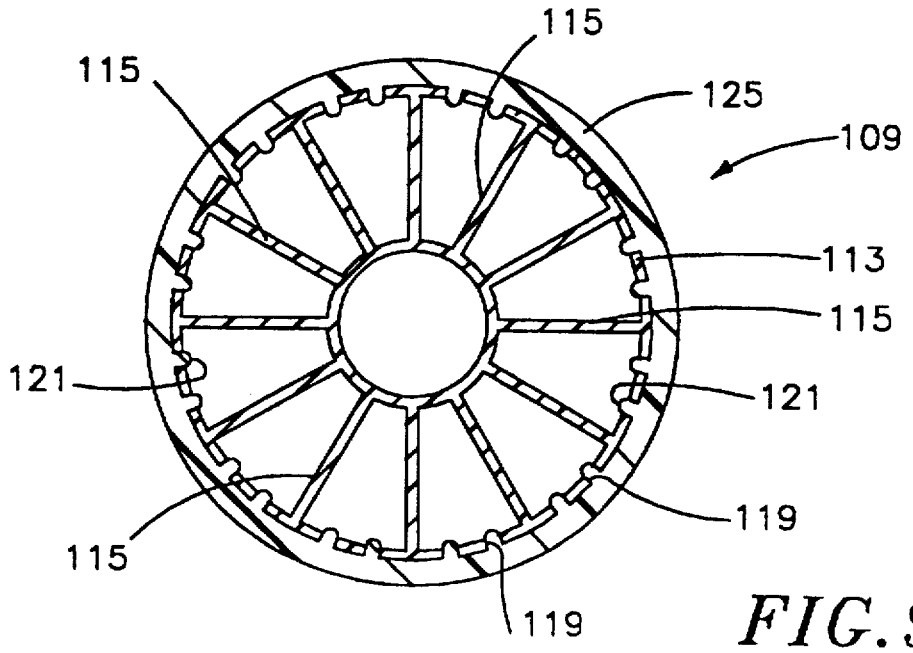
FIG. 9 is a sectional view taken along the line 9—9 of FIG. 8.

Referring now to FIGS. 8 and 9, construction of a preferred form of wheel 106 is shown in detail. The wheel 106 incorporates a unitary tread element and braking element and includes a bearing 107 about which is fitted a light-weight plastic cage 109 which is generally hollow, but includes a hub area 111 and an outer basket 113 joined together by a series of fins 115. The outer basket 113 includes a large circumference portion 114 which forms the tread of the wheel and a smaller diameter portion 116 which forms the braking element. The cage 109 is a relatively strong, light-weight member and serves to secure and support a layer of tough resilient material 117, such as urethane, which forms the contact surface, or tread, of the wheel. Preferably the basket 113 and fins 115 are formed with a plurality of openings 119 which not only serve to further reduce the weight of the hub, but also to provide an anchor for the urethane which, when applied will penetrate the holes 119 and form anchor stubs 121 securing the urethane to the cage 109.

It will be noted that the urethane, which is a relatively heavy material, is applied very thinly, that is from 2 to 10 mm and, preferably about 2.5 mm, at the normal skating, or tread, area 123. In the braking area 125, the urethane is much thicker and preferably more than 5 mm. Thus, a heavy coating of urethane is applied only in the areas where it is principally needed thereby further reducing the overall weight of the wheel.

The axle 79 for the wheel is shown as being affixed to the vertical bracket 89 of the frame 77 by means of nuts 127 and 129.

In using the skate as described, the tread element 123 of the wheel 106 is in contact with the skating surface during the time of normal skating. When the skater decides to stop or brake, he may turn his skates perpendicular to the direction of motion and lean backward, whereby the sloped surface, which forms a braking area 125, comes in contact with the skating surface to provide an effective braking action. It should be recognized that the skater may apply the braking action by pushing primarily with his heel, with the center of his foot, or any other portion of his foot, merely by adjusting the position of his foot relative to the sliding direction. Since urethane is a somewhat soft material, it will somewhat flatten as it is placed into pressured engagement with the skating surface and thereby broaden the frictional area as described hereinafter. On the other hand, in the tread or normal skating area 123 of the wheel 106, the urethane is in a relatively thin layer not given to substantial flattening and thereby permitting a relatively higher speed as the wheel crosses the skating surface.

In combination then, the relatively small wheels, having a tread diameter in the neighborhood of 40 mm; the light weight of those wheels by means of the reduction in the amount of urethane used; the large plurality of the wheels; and the wheels being disposed along a rocker arc; all provide an in-line skate having skating characteristics very similar to those of the usual ice skate.

While the wheel 106 has been described as having an tread element 123 and a conical braking element 125, various other shapes may be employed for the braking element of the wheel.

Figure 10:
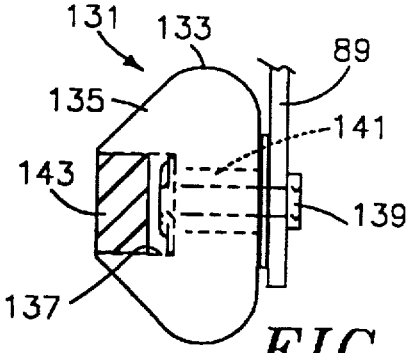
FIG. 10 is a cross sectional view similar to the sectional view of the wheel in shown in FIG. 8 but showing a wheel having a shorter axle and bearing together with a removable plug.

Referring now to FIG. 10, a wheel 131 is provided again having a tread element 133 and a conical braking element 135. The conical braking element, however, is provided with an opening 137 which permits the use of a considerably shorter axle 139 and bearing 141. If desired, a plug 143, can be positioned in the opening 137 to provide additional stiffness to the conical braking element 133.

Figure 11:
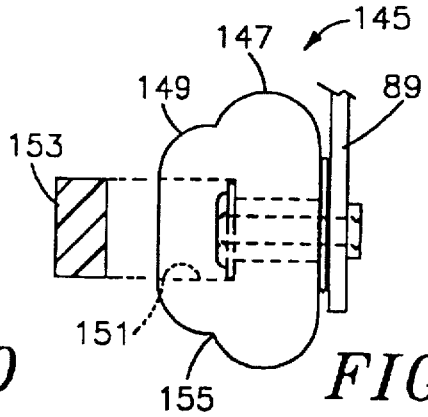
FIG. 11 is a view similar to FIG. 10 but showing a different form of wheel having a "virtual edge" comprising a spherical, as opposed to a conical, braking element and also having a plug to stiffen the braking element.

Referring to FIG. 11, another variation is shown wherein a wheel 145 is provided having the usual tread element 147, but including an ellipsoidal braking element 149 as opposed to the conical braking element 145 of FIG. 10. Again, an opening 151 is provided into which a plug 153 may be inserted. It should also be noted that in the embodiment shown in FIG. 11, the braking element 149 does not extend tangentially to the tread element 147, but rather leaves a reentrant annular groove 155. With the embodiment shown in FIG. 11, particularly when the plug 153 is not employed, the ellipsoid braking element 159 will, during braking action, have a tendency to spread away from the tread element 147 where in contact with the skating surface and to fold into the reentrant portion 155 in the area remote from the skating surface. This will also provide greater skating surface contact and, of course, it will provide a substantially different feel to the skater which may be more comfortable to certain skaters.

Figure 12:
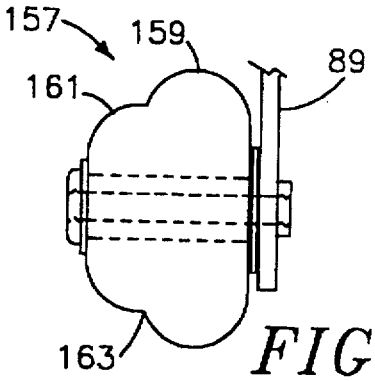
FIG. 12 is a view similar to FIG. 10 but showing an alternative wheel having an ellipsoidal braking element.

Referring now to FIG. 12, there is shown still another embodiment 157 of the wheel including a tread element 159 and, in this case, a semi-spherical braking element 161. Again, a reentrant annular groove 163 is included which permits the semi-spherical braking element 161 to somewhat flatten where in contact with a skating surface and fold in on the upper side of the wheel.

Figure 13:
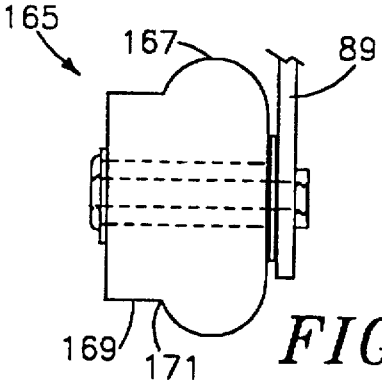
FIG. 13 is a view similar to FIG. 10 but showing a cylindrical braking element.

Referring to FIG. 13, there is still another embodiment 165 of the wheel which includes a tread element 167 and a braking element 169 which in this instance is in the shape of a cylinder. The cylinder 169 does not join the tread element 167 in a tangential manner and again an annular reentrant groove 171 is provided to produce the same effect as such grooves in the embodiments of FIGS. 11 and 12.

Figure 14:
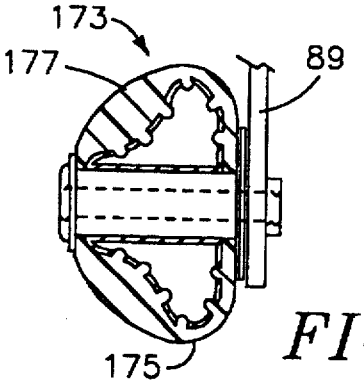
FIG. 14 is another view similar to FIG. 10 but showing a substantially semispherical braking element having a diameter equal to the outer diameter of the standard wheel element itself.

Referring to FIG. 14, there is still another embodiment of a wheel 173 is shown. In this instance, the tread element 175 of the wheel tangentially merges into the semi-spherical braking element 177 at the outer extremity of the tread.

Figure 15:
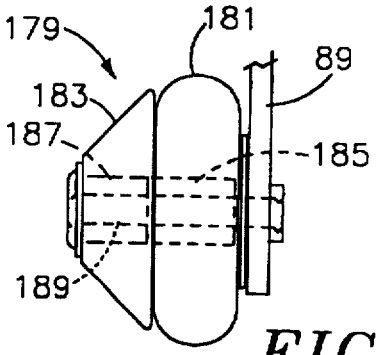
FIG. 15 is another view similar to FIG. 10 but showing the wheel and the braking element as separate units each having its own bearing.

Referring to FIG. 15, an embodiment 179 of the wheel is shown which is essentially the same as the embodiment shown in FIG. 6. Contrary to the embodiments of FIGS. 8 through 14 showing unitary braking and tread elements, the embodiment of FIG. 15 has separate braking and tread elements. Here the tread element 181 and the conical braking element 183 are separate with separate bearings 185 and 187, but on a common axle 189. In the embodiment of FIG. 15, the tread element 181 and the conical braking element 183 are free to rotate independently and they therefore may rotate at different speeds to accommodate the fact that the circumferences of the tread element and the conical braking element are quite different. If desired, anti-friction means may be provided between tread element 181 and conical braking element 183 to further facilitate the different speeds of rotation in the two units.

Figure 16:
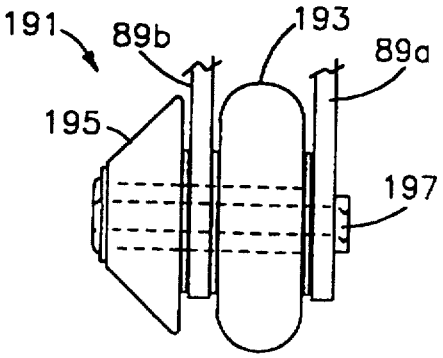
FIG. 16 is a view similar to FIG. 15 but showing a double bracket support, rather than a single bracket of the previous drawings, and having one of the two brackets being disposed between the wheel and the braking elements.

In FIG. 16, still another embodiment 191 of the wheel is shown including a separate tread element 193 and conical braking element 195. It should be recognized, however, that rather than a single vertical bracket 89 of the frame 77, there are provided two downwardly extended brackets **89*a* and 89*b*, similar in many respects to the inverted U-shaped frame of the prior art skate shown in FIG. 2. The axle 197, extends through both of the downward extensions 89*a* and 89*b* of the frame and, in this instance, carries the conical braking element 195 totally outside the frame. Such a feature will be useful in a case of particularly heavy skaters who may apply too much force during a braking maneuver for single vertical section 89 such as shown in the skate of FIGS. 5 and 6**.

Figure 17:
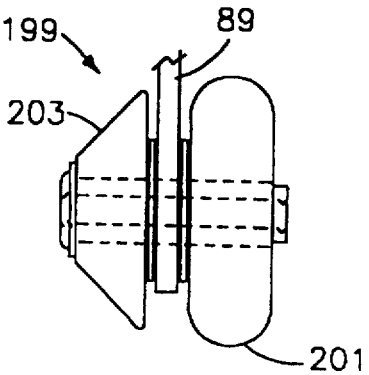
FIG. 17 is another view similar to FIG. 15 but showing the bracket being disposed between the wheel and the braking element.

In FIG. 17, still another embodiment 199 of the wheel is shown. In this case, the tread element 201 and the conical braking element 203 are again separate, but they are disposed on opposite sides of the brace 89. Thus, the frame 89 itself can provide separation and the reduction of friction between elements 201 and 203, thereby permitting substantially different speeds of rotation of the two elements.

Figure 18:
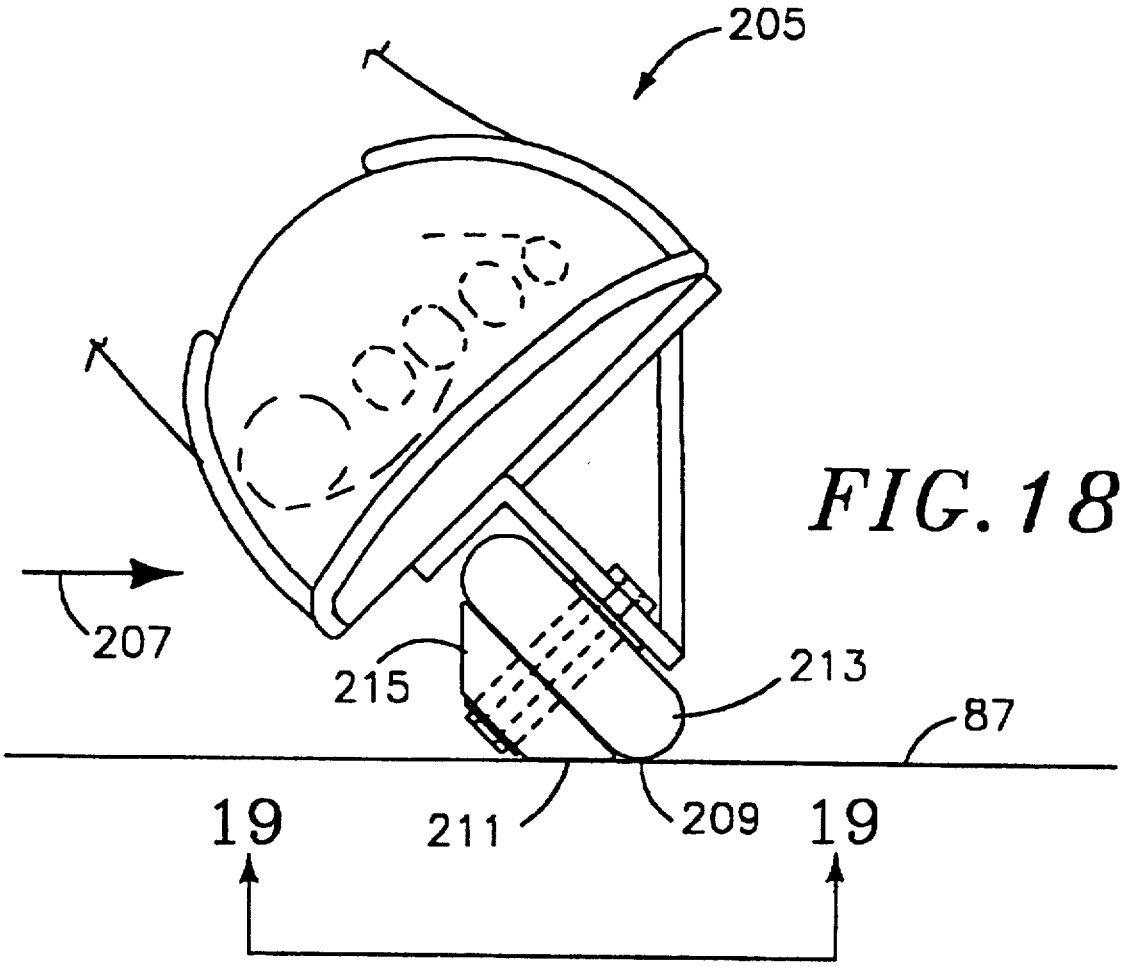
FIG. 18 is a view of a skate similar to that of FIG. 6, but shown in a braking position.
Figure 19:
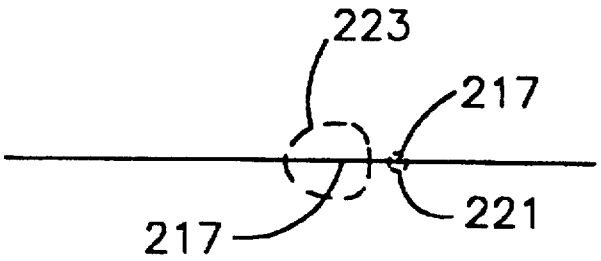
FIG. 19 is a view along the line 19—19 of FIG. 18 showing the area of contact between the tread and braking elements of the wheel with the skating surface.

Referring to FIGS. 18 and 19, a skate 205 in accordance with the invention is shown in a braking position. As shown, the skater has leaned over by an angle of about 45° and the direction of sliding/braking travel is as shown by the arrow 207. The lowermost surfaces 209 and 211 of the tread element 213 and braking potion 215, respectively, are in contact with the surface 87. If neither the surface 87 nor the urethane covering on the wheel were resilient, the contact would be at the point 217 and line 219 as shown in FIG. 19. However, because of the thin coating of resilient urethane on the tread element 213. There is an actual area of contact as shown by the small circle 221. Moreover, because of the thicker coating of urethane on the braking element 215, the actual contact is an enlarged area as shown by the line 223.

Because the braking element 215 is in the form of a 45° cone, the surface of the conical braking element contacts the surface 87 at such time as the skater leans 45°. If greater or lesser lean over is desired, a wider or narrower cone may be employed. For instance, a 60° cone would permit a 60° lean before the braking element contacts the surface 87; and a 30° cone would permit only a 30° lean. It should be kept in mind, however, that with a substantial lean over, the edge of the boot sole may contact the skating surface before the braking element 215 does so. Likewise, with other shapes of braking elements as shown in FIGS. 10 through 17, the degree of lean over required for braking can be determined by adjusting the axial extent of the braking element itself.

It should be recognized that the variations shown in FIGS. 8–17 may be combined with each other. For instance, the conical braking elements of FIGS. 15, 16 and 17 may be replaced by the ellipsoid, semi-spherical or cylindrical braking elements such as shown in FIGS. 11–14. It should be likewise recognized that the number of wheels may be different than the seven as shown in the drawings, keeping in mind that smaller diameter wheels permit a larger number and consequently are better suited for approximating the rocker of the usual ice skate.

I claim:

1.An inline roller skate for use on a generally horizontal skating surface comprising:

a) a boot;

b) a frame affixed to said boot; said frame including a downwardly extending bracket;

a series of at least six axle receiving holes in said bracket, said axle receiving holes being disposed along a downwardly extending arcuate line having a radius of from 2 to 4 meters;

c) an axle secured in each of said axle receiving holes;

d) a wheel element carried by each of said axles;

each of said wheel elements including a tread element having a diameter of from 35 mm to 45 mm and an axial width no greater than 15 mm;

at least two of said wheel elements having an adjacent braking element coaxial with said tread element;

said at least two wheel elements including a hollow cage having a plurality of openings formed therein and a sleeve for receiving one of said axles and an outer skin of tough resilient material secured to said cage, the thickness of said outer skin on said tread element being no greater than 10 mm and the thickness of said outer skin on said braking element being no greater than 5 mm; and said braking element of said at least two wheels forming an axial extension of said tread element, the extension being sufficiently long for the braking element to meet an imaginary line extending upwardly at an angle of at least 60° with the horizontal surface and at a tangent to said tread element closest to said surface when said tread element is vertically disposed.

2. An inline roller skate for use on a generally horizontal skating surface as set forth in claim 1 wherein said braking element is conical.

3. An inline roller skate for use on a generally horizontal skating surface as set forth in claim 1 wherein said braking element is ellipsoidal.

4. An inline roller skate for use on a generally horizontal skating surface as set forth in claim 1 wherein said braking element is cylindrical.

5. An inline roller skate for use on a generally horizontal skating surface as set forth in claim 1 wherein said braking element is semispherical.

6. An inline roller skate for use on a generally horizontal skating surface as set forth in claim 5 wherein said semispherical braking element is joined to said tread element tangentially at an outermost portion of said tread element.

7. An inline roller skate as defined in claim 1 wherein said bracket lies in a single vertical plane.

8. An inline roller skate as defined in claim 1 wherein said bracket comprises a single downwardly extending bracket.

9. An inline roller skate as defined in claim 1 wherein said wheel and braking elements are unitary.

10. An inline roller skate as defined in claim 9 wherein said braking element comprises a conical axial extension of said wheel element.

11. An inline roller skate as defined in claim 9 wherein said braking element comprises an ellipsoidal axial extension of said wheel element.

12. An inline roller skate as defined in claim 9 wherein said braking element comprises a cylindrical axial extension of said wheel element.

13. An inline roller skate as defined in claim 9 wherein said braking element comprises a semispherical axial extension of said wheel element.

14. An inline roller skate as defined in claim 3 wherein said semispherical axial extension is joined to said wheel element tangentially at the outermost portion of said wheel element.

15. An inline roller skate as defined in claim 9 wherein said braking element includes an outer coating of tough resilient material; said braking element defining an axial recess adapted to receive a plug.

16. An inline roller skate as defined in claim 1 wherein said wheel and braking elements are separate elements.

17. An inline roller skate as defined in claim 16 wherein said braking element comprises a conical axial extension of said wheel.

18. An inline roller skate as defined in claim 1 wherein said wheel and braking elements are disposed on opposite sides of said bracket means.

19. An inline roller skate as defined in claim 18 wherein said braking element is conical.

20. An inline roller skate as defined in claim 18 wherein said braking element is ellipsoidal.

21. An inline roller skate as defined in claim 18 wherein said braking element is cylindrical.

22. An inline roller skate as defined in claim 18 wherein said braking element is semispherical.

23. An inline roller skate as defined in claim 1 wherein said bracket comprises a pair of spaced parallel downwardly extending members; said wheel element being disposed between said members and said braking element being disposed outside said members.

24. An inline roller skate as defined in claim 23 wherein said braking element is conical.

25. An inline roller skate as defined in claim 23 wherein said braking element is ellipsoidal.

26. An inline roller skate as defined in claim 23 wherein said braking element is cylindrical.

27. An inline roller skate as defined in claim 23 wherein said braking element is semispherical.

* * * * *